US005702268A

United States Patent [19]

Lien et al.

[11] Patent Number: 5,702,268

[45] Date of Patent: Dec. 30, 1997

[54] CHRISTMAS LAMP SOCKET

[75] Inventors: Tzung-Min Lien; Tzung-Shih Lien, both of Chu Nan Chen, Taiwan

[73] Assignee: Chen Yn Enterprise Co., Ltd., Miao Li Hsien, Taiwan

[21] Appl. No.: 657,561

[22] Filed: Jun. 4, 1996

[51] Int. Cl.[6] ..... H01R 4/24

[52] U.S. Cl. ..... 439/419; 439/340; 439/575

[58] Field of Search ..... 439/336, 340, 439/356, 375, 419, 575, 602, 699.2

[56] References Cited

U.S. PATENT DOCUMENTS 5,634,812 6/1997 Chen ..... 439/419

*Primary Examiner*—Neil Abrams
*Assistant Examiner*—Brian J. Biggi
*Attorney, Agent, or Firm*—Morton J. Rosenberg; David I. Klein; Jun Y. Lee

[57] ABSTRACT

The present invention relates to a Christmas lamp socket. The socket mainly includes a housing member and an affixing part. The affixing part has a pair of opposing erection parts to be fitted into, and secured by, a pair of corresponding elongate trenches on the inner circumference of the housing member. The housing member has two holes on a mediate portion. The holes communicate with cords held between the mediate portion and a bottom of the housing member. The affixing part is fitted with two conductors which pass through the holes of the housing to connect with wires of the cords.

3 Claims, 5 Drawing Sheets

CHRISTMAS LAMP SOCKET

BACKGROUND OF THE INVENTION

A common Christmas lamp socket is provided. Referring to FIG. 6, the socket comprises a housing 10 and a bottom member 60. The housing 10 has an inner circumference defining a hollow into which a bulb 70 is inserted from a lower part of the bulb 70. A plurality of copper threads 20 are provided on the inner circumference of the housing 10 for conducting electricity. A vertical conductor 30 is fastened to the circumference of the housing 10, while, a horizontal conductor 40 is fastened on a bottom of the housing 10. The housing 10 has a channel 101 thereacross on a lower end thereof for holding cords 50 inside the channel 101. The conductors 30, 40 have piercing ends 301, 401 respectively such that the piercing ends 301, 401 penetrate insulation covers of the cords 50 and connect with wires of the cords 50. The bottom member 50 has two erecting poles to pass into two corresponding through holes on a bottom of the housing 10 in order to firmly combine the bottom member 60 with the housing 10.

Nevertheless, because the space of said through holes of the housing 10 is tight for said erecting poles to fit thereinto, the manufacturer usually has the erecting poles manually partially inserted into the through holes and then has the rest of insertion done by a machine. It is not convenient and cost quite a little labor and processing time to fit the bottom member in position.

Furthermore, water is likely to leak into the Christmas lamp socket through the channel 101 and the joint between the bottom member and the housing and through an aperture between the bulb 70 and the housing 10. So, it is not favorable to fit the socket outdoors for fear of rain causing water leakage and consequent damage of the socket. Use of the socket is restricted.

SUMMARY OF THE INVENTION

The present invention relates to a Christmas lamp socket. The socket comprises a housing member and an affixing part. The affixing part has a pair of opposing erection parts to be fitted into, and secured by, a pair of corresponding elogate trenches on the inner circumference of the housing member. The housing member has two holes on a mediate portion. The holes communicate with cords held between said mediate portion and a bottom of the housing member. The affixing part is fitted with two conductors which pass through said holes of the housing to connect with wires of said cords. An annular pad is disposed between the bulb and an upper end of the housing member.

The socket of the present invention has the following advantages:

1. The housing member is made to simultaneously have the cords held between the bottom and the mediate portion of the housing member so that water leakage is prevented.

2. The affixing part fitted with the conductors can be easily inserted into the housing member in terms of assemblying process.

3. The annular pad contributes to preventing water leakage through the upper end of the socket.

BRIEF DESCRIPTION OF THE DRAWINGS

The invention will be better understood by reference to the accompanying drawings, wherein.

DESCRIPTION OF THE PREFERRED EMBODIMENTS

Figure 1:
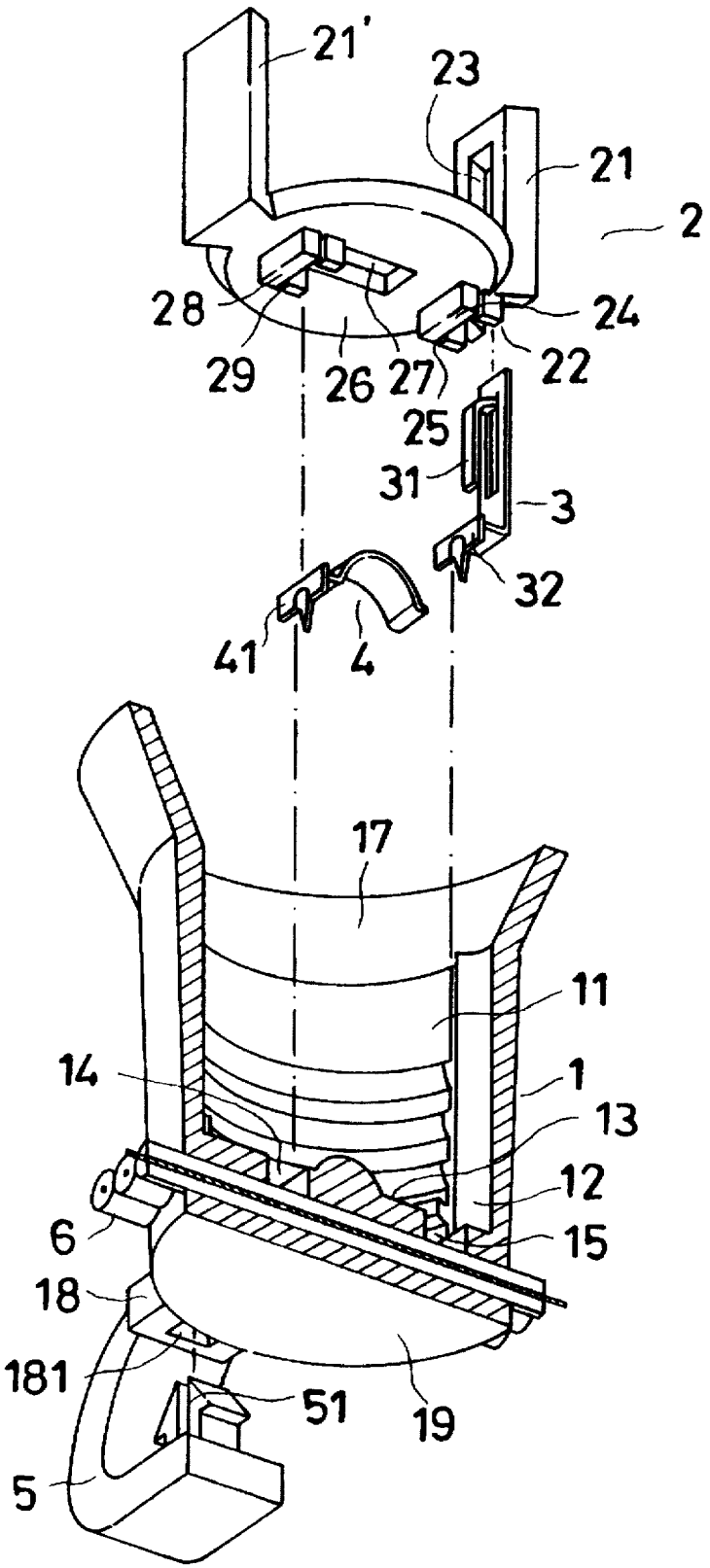
FIG. 1 is an exploded view of a Christmas lamp socket of the present invention.
Figure 3:
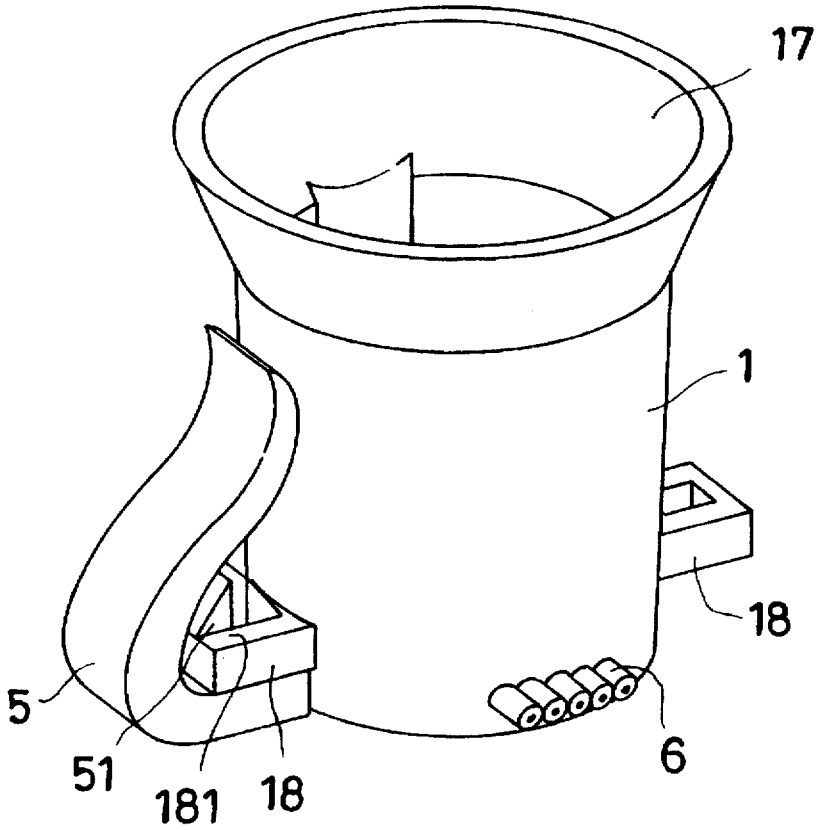
FIG. 3 is a view showing the appearance of the present invention Christmas lamp socket.
Figure 2:
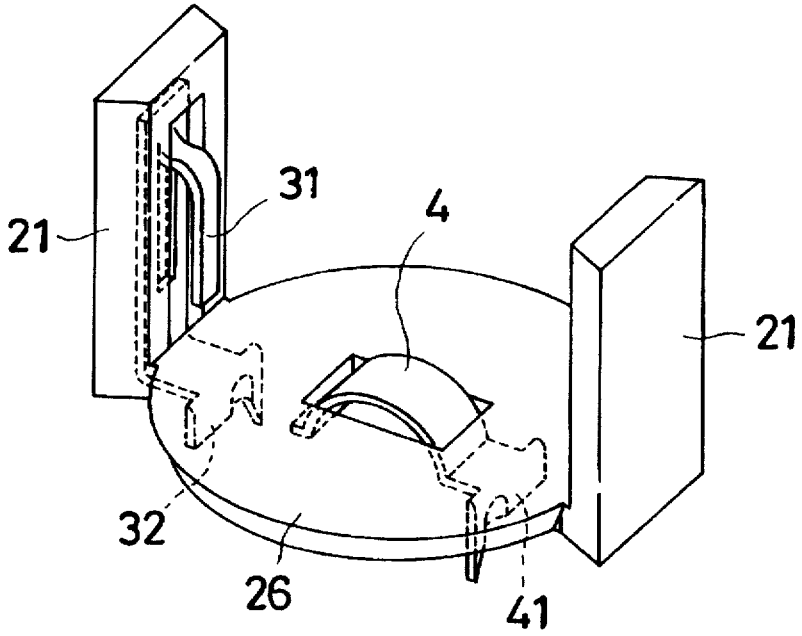
FIG. 2 is a view showing the affixing part fitted with the conductors according to the present invention.
Figure 4:
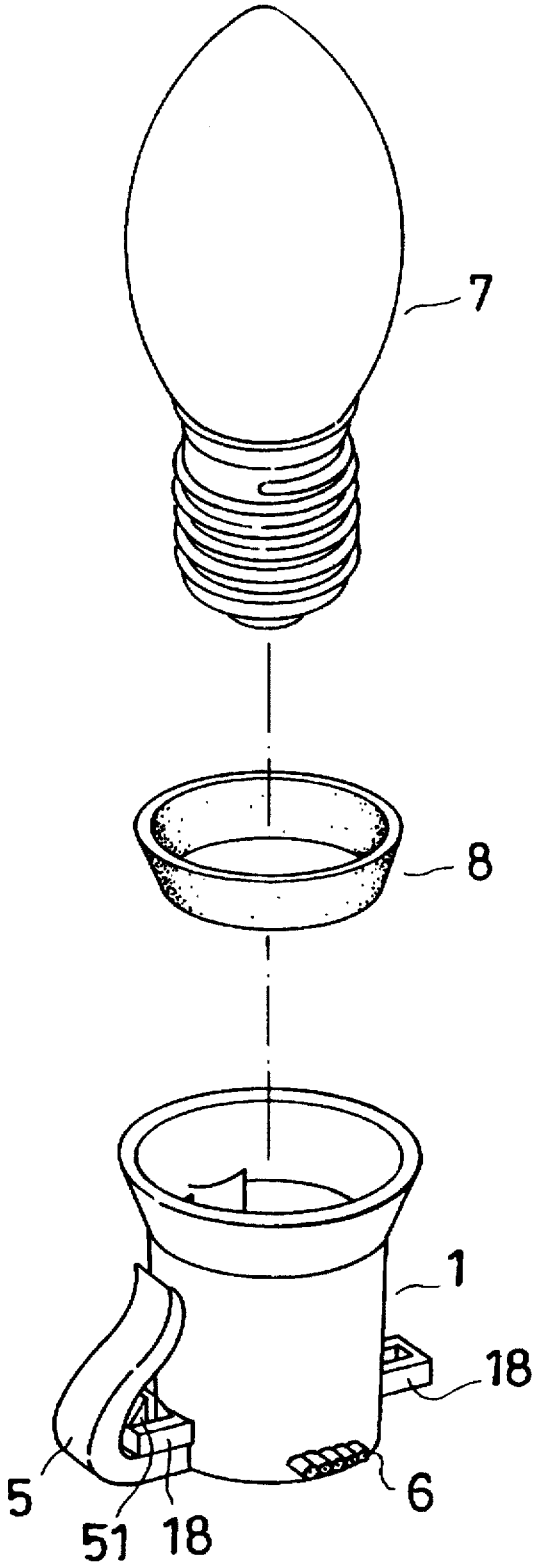
FIG. 4 an exploded view of a bulb, and the annular pad and the Christmas lamp socket of the present invention.
Figure 5:
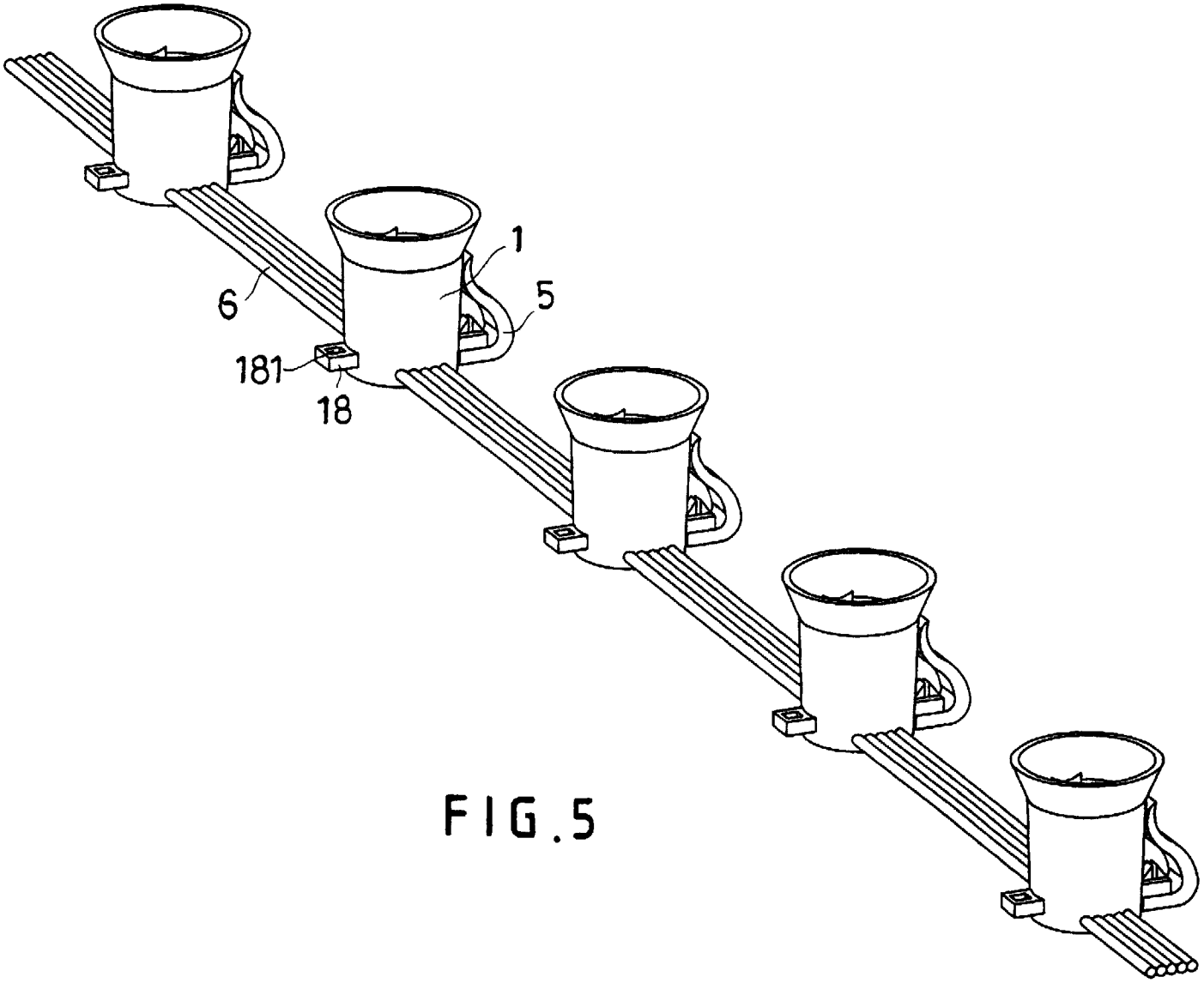
FIG. 5 is view showing a formation of a plurality of the present invention Christmas lamp sockets; and, FIG. 6 is a plan of the prior art Christmas lamp socket and a bulb.
Figure 6:
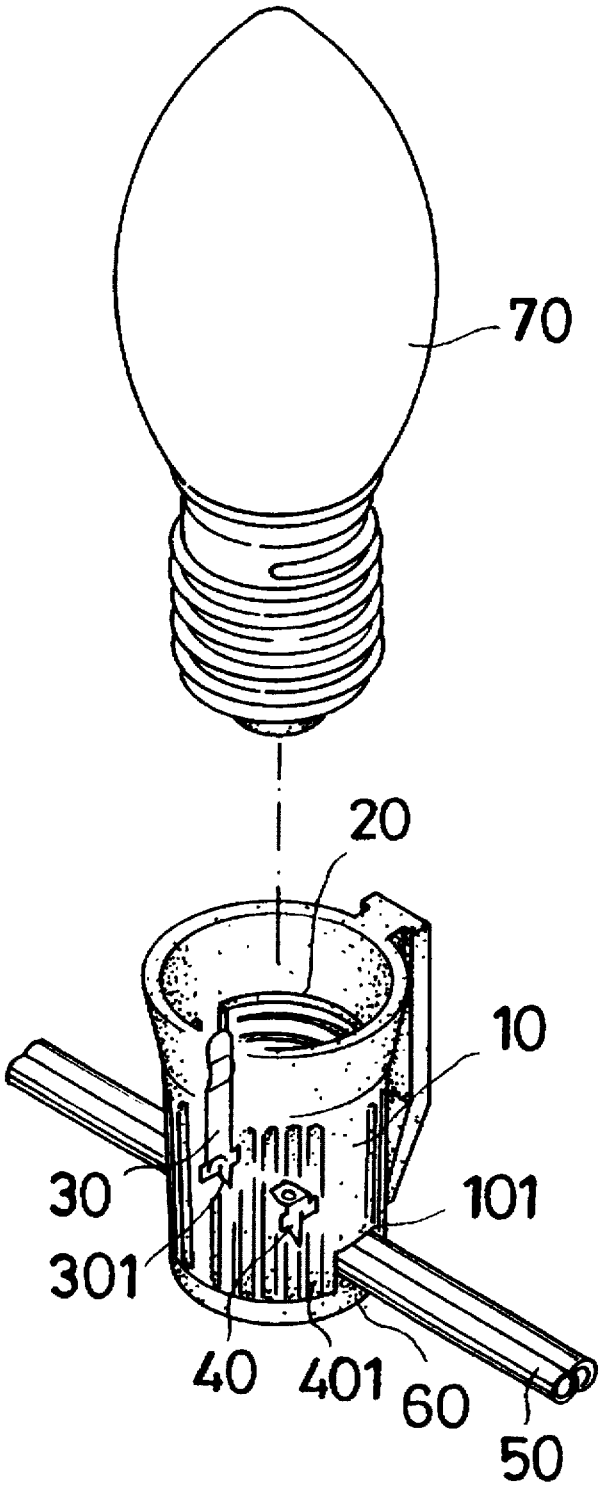
FIG. 6 (PRIOR ART)

The present invention relates to a Christmas lamp socket. Referring to FIGS. 1, 2, the socket comprises a housing member 1, an affixing part 2, a first conductor 3, a second conductor 4, a connecting member 5, a plurality of cords 6, and a bulb 7.

The housing member 1 has an inner circumference 11 defining a central hollow thereof, and a mediate portion 13 defining a lower perimeter edge of said central hollow. The housing member 1 is made to simultaneously have the cords 6 held between a bottom 19 and the mediate portion 13 of the housing member there is no aperture between joint of the cords 6 and the housing member 1 or between the bottom 19 and the mediate portion 13. There are formed a first through hole 14, and a second through hole 15 on the mediate protion 13; said through holes 14, 15 are arranged so as to communicate with the part of the cords 6 between the bottom 19 and the mediate portion 13. Two opposing elongate trenches 12 are formed on the inner circumference 11 of the housing member 1. The housing member 1 further has an open 17 on an upper part thereof, and two projections 18 on an outside thereof, each projection 18 having a hole 181.

The affixing part 2 includes a bottom portion 26 and two inserted erection parts 21, 21' opposing each other and erecting upward from perimeter edge of the bottom portion 26. The inserted erection part 21 has an elongate opening 23, and a holding chamber 22 formed outwardly of the bottom portion 26 for insert of the first conductor 3 thereinto, the chamber 22 being formed to have an open lower end for said insert of the first conductor 3 to be started therefrom.

The first conductor 3 has an elastic touching part 31 on an upper portion thereof, and a piercing part 32 protruding downward form a bent lower portion of the first conductor 3. The elastic touching part 31 is arranged such that it projects from the elongate opening 23 when the first conductor 3 is inserted into the holding chamber 22 of the inserted erection part 21. The second conductor 4 is arcuately curved on a mediate portion thereof, and has a piercing part 41 protruding from one bent end adjacent to said curved mediate portion thereof.

A through hole 27 is formed on the bottom portion 26 of the affixing part 2 for inserting said curved mediate portion of the second conductor 4 therethrough.

Furthermore, a first shaped block 24 is provided on the bottom portion 26 adjacent to said open lower end of said holding chamber 22 and has apertures 25 such that said bent lower portion of the first conductor 3 is secured inside the first shaped block 24 and the piercing part 32 is secured by said apertures after said insert of the first conductor 3. There is also formed a second shaped block 28 with apertures 29 on the bottom portion 26. The block 28 is arranged adjacent to the through hole 27 such that said end adjacent to said curved mediate portion of the second conductor 4 is secured inside the second shaped block 28 and said piercing part 41 is secured by said apertures 29 after said insert of said curved mediate portion of the second conductor 4 through the through hole 27.

In combination, the affixing part 2 connected with the conductors 3, 4 is inserted into the hollow of the housing member 1 from the opening 17. Each of the inserted erection parts 21, 21' is fitted into a respective one of said opposing elongate trenches 12, and the piercing parts 3, 4 are passed through the through holes 14, 15 respectively and thereafter each penetrates a respective insulation cover of the cords 6 to connect with inner conducting wires of the cords 6.

The connecting member 5 has a curved shape and an elastic coned part 51 at one end thereof such that the connecting member 5 is connected with one of the projections 18 by inserting the elastic coned part 51 through the hole 181. The connecting member 5 is provided for any of said cords 6 to pass therethrough in order to knit a plurality of Christmas lamp sockets of the kind according to the present invention into a desired formation. The other projection 18 is provided for a screw and the like to pass through the hole 181 thereof in order to affix the present socket on billboards or other things to be decorated.

Furthermore, an annular pad 8 is provided and disposed between the open 17 of the housing member 1 and the bulb 7 in order to prevent water leakage from outside into the socket.

From the above, it can be seen that the Christmas lamp socket of the present invention has advantages as follows:

1. The housing member is made to simultaneously have the cords held between the bottom and the mediate portion of the housing member so that water leakage is prevented.

2. The annular pad contributes to preventing water and rain leakage into the socket reducing risk of the Christmas lamp getting damaged.

3. The projections of the present invention make securing the lamps onto billboards very easy.

While the preferred embodiments of the invention have been described above, it will be recognized and understood that various modifications may be made therein and the appended claims are intended to cover all such modifications which may fall within the spirit and scope of the invention.

What is claimed is:

1. A Christmas lamp socket comprising:

a first conductor having an elastic touching part projecting on an upper portion thereof and a piercing part protruding from a bent lower end thereof;

a second conductor having an arcuately curved mediate portion and a piercing part projecting from a bent end adjacent to said curved mediate portion;

an affixing part having a bottom portion, a first and a second erection parts arranged opposite to each other adjacent to said bottom portion;

said bottom portion having a through hole, the curved mediate portion of the second conductor being inserted through said through hole of said bottom portion;

said first erection part having a holding chamber, said first conductor being inserted into and secured inside the holding chamber; an elogate opening being provided on the first erection part adjacent to the holding chamber; the elastic touching part projecting from the elongate opening after said insertion of the first conductor;

a first shaped block on the bottom portion, the first shaped block holding said bent lower end of said first conductor therein and having apertures to secure the piercing part of the first conductor in position after said insertion of the first conductor;

a second shaped block on the bottom portion, said second shaped block holding said bent end of the second conductor therein and having apertures to secure the piercing part of the second conductor after said insertion of the second conductor;

a housing member having an inner circumference defining a central hollow thereof, an opening on an upper part thereof, a bottom and a mediate portion defining a lower end of said central hollow; said opening being provided for a bulb to be inserted therethrough into said central hollow;

said inner circumference having a pair of opposing elongate trenches to detain a respective one of said first and second erection parts therein upon insertion of said affixing part into said central hollow;

said housing member being made with a plurality of cords being simultaneously held between said bottom and said mediate portion thereof;

said mediate portion having two through holes communicating with said cords held between said bottom and said mediate portion, said piercing parts of the first and second conductors being passed through a respective one of said through holes of said mediate portion in order for said piercing parts to penetrate insulation covers of said cords and connect with inner conducting wires of said cords upon said insertion of said affixing part.

2. The Christmas lamp socket as recited in claim 1 further comprising a pair of projections projecting from an outside of the housing member and a connecting member, said connecting member having a curved shape and an elastic coned part, said pair of projections each having a hole, said elastic coned part being inserted into, and held by, said hole of one of said projections.

3. The Christmas lamp socket as recited in claim 1 further comprising an annular pad disposed between said opening of the housing member and the bulb, said annular pad being shaped such that water is prevented from leaking through the upper part of the socket.

* * * * *

UNITED STATES PATENT AND TRADEMARK OFFICE

CERTIFICATE OF CORRECTION

PATENT NO. : 5,702,268

DATED : 12/30/1997

INVENTOR(S) : TZUNG-MIN LIEN & TZUNG-SHIH LIEN

It is certified that error appears in the above-identified patent and that said Letters Patent is hereby corrected as shown below:

On the title page item,

[73] delete the Assignee Name "Chen Yn Enterprise Co., Ltd." and insert the name --Chen Yu Enterprise Co., Ltd.--

Signed and Sealed this

Twenty-eighth Day of April, 1998

Bruce Lehman

*Attest:*

BRUCE LEHMAN

*Attesting Officer*

*Commissioner of Patents and Trademarks*